US011434445B2

(12) United States Patent
Fujimaki et al.

(10) Patent No.: US 11,434,445 B2
(45) Date of Patent: Sep. 6, 2022

(54) LUBRICANT COMPOSITION FOR BALL JOINTS

(71) Applicant: SHELL OIL COMPANY, Houston, TX (US)

(72) Inventors: Yoshitomo Fujimaki, Kanagawa (JP); Hiroki Yano, Tokyo (JP); Kunitoshi Abe, Tokyo (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/417,157

(22) PCT Filed: Dec. 23, 2019

(86) PCT No.: PCT/EP2019/086915
§ 371 (c)(1),
(2) Date: Jun. 22, 2021

(87) PCT Pub. No.: WO2020/136163
PCT Pub. Date: Jul. 2, 2020

(65) Prior Publication Data

US 2022/0049175 A1 Feb. 17, 2022

(30) Foreign Application Priority Data

Dec. 27, 2018 (JP) ..... JP2018-244984

(51) Int. Cl.
*C10L 1/16* (2006.01)
*C10M 107/14* (2006.01)
(Continued)

(52) U.S. Cl.
CPC ..... *C10M 107/14* (2013.01); *C10M 133/20* (2013.01); *C10M 169/04* (2013.01);
(Continued)

(58) Field of Classification Search
CPC ..... C10M 107/14; C10M 133/20; C10M 169/04; C10M 2205/063; C10M 2215/08;
(Continued)

(56) References Cited

U.S. PATENT DOCUMENTS 6,500,787 B1 * 12/2002 Tanaka ..... C10M 161/00 508/451
7,053,028 B2 5/2006 Kawamura et al.
(Continued)

FOREIGN PATENT DOCUMENTS

CN 101575548 A 11/2009
JP H06116581 A 4/1994
(Continued)

OTHER PUBLICATIONS

International Search Report and Written Opinion received for PCT Patent Application No. PCT/EP2019/086915, dated Mar. 25, 2020, 08 pages.
(Continued)

*Primary Examiner* — Prem C Singh
*Assistant Examiner* — Francis C Campanell
(74) *Attorney, Agent, or Firm* — Shell USA, Inc.

(57) ABSTRACT

The invention provides a grease composition for a ball joint which has a low friction coefficient under a load from normal temperatures to high temperatures, a small difference between static friction and dynamic friction, and little change in the friction coefficient even after repeated operation. TO this end, the invention provides a grease composition for a ball joint comprising: (i) a polyisoprene rubber and/or (ii) a polyisoprene rubber viscous material; a specific aliphatic amide and/or a specific aliphatic bisamide; and a specific urea compound.

2 Claims, 3 Drawing Sheets

(51) Int. Cl.

| | |
|---|---|
| ***C10M 133/20*** | (2006.01) |
| ***C10M 169/04*** | (2006.01) |
| *C10N 20/02* | (2006.01) |
| *C10N 20/04* | (2006.01) |
| *C10N 30/02* | (2006.01) |
| *C10N 30/06* | (2006.01) |
| *C10N 40/02* | (2006.01) |
| *C10N 50/10* | (2006.01) |

(52) U.S. Cl.
CPC ... *C10M 2205/063* (2013.01); *C10M 2215/08* (2013.01); *C10M 2215/102* (2013.01); *C10N 2020/02* (2013.01); *C10N 2020/04* (2013.01); *C10N 2030/02* (2013.01); *C10N 2030/06* (2013.01); *C10N 2040/02* (2013.01); *C10N 2050/10* (2013.01)

(58) Field of Classification Search
CPC ..... C10M 2215/102; C10N 2020/02; C10N 2020/04; C10N 2030/02; C10N 2030/06; C10N 2040/02; C10N 2050/10
USPC ..... 508/591
See application file for complete search history.

(56) References Cited

U.S. PATENT DOCUMENTS

| | | | | |
|---|---|---|---|---|
| 8,513,173 | B2 | 8/2013 | Kinoshita et al. | |
| 2006/0264338 | A1* | 11/2006 | Kawamura ..... | C10M 123/04 508/168 |
| 2020/0181528 | A1 | 6/2020 | Kochi et al. | |

FOREIGN PATENT DOCUMENTS

| | | | |
|---|---|---|---|
| JP | 4245714 | B2 | 4/2009 |
| JP | 2009210116 | A | 9/2009 |
| KR | 20050022236 | A | 3/2005 |
| WO | 2009042507 | A1 | 4/2009 |
| WO | 2010069984 | A1 | 6/2010 |

OTHER PUBLICATIONS

Office Action Received for Chinese Application No. 201980085500.0, dated Feb. 22, 2022, 15 Pages(08 Pages of English Translation and 07 Pages of Official Copy).

* cited by examiner

LUBRICANT COMPOSITION FOR BALL JOINTS

CROSS REFERENCE TO RELATED APPLICATIONS

This is a national stage application of International application No. PCT/EP2019/086915, filed 23 Dec. 2019, which claims priority of Japan application No. 2018-244984, filed 27 Dec. 2018.

FIELD OF THE INVENTION

The present invention relates to a lubricating grease composition for use in a ball joint. Specifically, the present invention relates to a grease composition for a ball joint suitable for lubrication between a ball seat and a ball stud in a ball joint composed of a synthetic resin ball seat, a metal ball stud, and a socket.

BACKGROUND OF THE INVENTION

In general, the gap between the synthetic resin ball seat 1 and the metallic ball stud 2 in the plastic ball joint used in an automobile, as shown in FIG. 1, is coated to perform a lubricating function. In order to maintain and improve the performance of the ball joint, several techniques have been used, such as increasing hardness of the ball stud to suppress wear, including molybdenum, graphite, or a lubricating oil in the ball seat to improve the lubricity of the resin itself, and forming a groove in an inner surface of the ball seat to provide an oil reservoir (grease reservoir) for improving lubricity.

However, because there are limits to improving the performance of a ball joint using these techniques and because the effect is small, the performance of joints currently relies on lubricants such as grease, and demand for higher performance greases and lubricants is great.

Further, ball joints are located in a very important part of the operating system for a suspension device or a steering device. When rattling of the joint occurs, it is a fatal problem for the ball joint in that the amount of displacement of the ball stud varies or increases under load because the ball joint directly affects the running performance of the vehicle. Thus, a plastic ball joint mechanism is placed under a certain load that is maintained while the ball stud and the synthetic resin ball seat are assembled in the socket so that clearance between the ball stud and the ball seat is reduced as much as possible utilizing the viscoelasticity of synthetic resin and so that displacement of the ball stud is minimized under the load. Because a certain amount of pressure is maintained between the ball stud and the ball seat, grease is pushed out from between the ball stud and the ball seat over time in the case of a typical lubricating grease. As a result, operating torque increases, a break in the oil film occurs over the course of repeated operation, the ball stud and the ball seat come into direct contact with each other causing wear, and ball stud displacement increases. Furthermore, in addition to reductions in resistance to the streamline flow of air over the body of automobiles with accelerating improvement in the aerodynamic characteristics of automobiles, designs in recent years have incorporated significant improvements in the streamline flow of air over the chassis (underneath the floor). However, because air taken into the body is restricted, one trade-off has been a tendency for the temperature to rise near the tires and suspension in addition to a rise in temperature in components near the engine. Ball joints are used in the inner portion of the steering mechanism (close to the engine), on tie rod ends (close to the tires), and in the lower arm portion of the suspension. Because the temperature of ball joints also rises against this backdrop, demand for heat resistance in the grease used in these portions has also increased in recent years.

Therefore, performance requirements of grease for ball joints include the grease strongly adhering between the ball stud and the ball seat under a load from normal temperatures to high temperatures; the lubricant flowing smoothly while maintaining a constant film thickness in sliding portions going from a stationary state to a moving state; and the grease providing stable lubricating characteristics with very little change in the lubricating film even after repeated operation. In other words, the friction coefficient must be small under a load from normal temperatures to high temperatures, the difference between the static friction and dynamic friction must be small, and the change in the friction coefficient must be small, even after repeated operation.

JP4199109 B2 discloses a technique for providing a lubricant composition and a ball joint in which a grease composition for a ball joint comprising a base oil containing a synthetic hydrocarbon oil, a thickener, and a compound such as Duomeen T dioleate has excellent low friction performance at normal temperatures and excellent friction performance from high temperatures to low temperatures in a ball joint. In other words, it is free of the risk of leaking from a ball joint at high temperatures.

JP4245714 B2 discloses a technique in which a lubricant composition for a ball joint, comprising at least one type selected from a group consisting of polyisoprene rubbers and polyisoprene rubber viscous materials, at least one amide compound selected from a group consisting of aliphatic amides and aliphatic bisamides, and at least one wax selected from a group consisting of polyethylene waxes, paraffin waxes and microcrystalline waxes, has low torque and is stable in a ball joint over a wide range of temperatures from normal temperatures to high temperatures. The torque at normal temperatures is especially low and wear resistance is good in durability testing.

JP2017149905 A discloses a technique for providing a grease composition, in which a grease composition comprising a base oil containing an ethylene-α-olefin copolymer, a thickener, and a polar wax, can reduce ball seat wear in the sliding portion and has very good compatibility with a dust cover.

While these lubricants and grease compositions for ball joints exhibit low torque and low friction characteristics under certain conditions, there has not yet been provided a composition with a good overall balance that addresses the current problem. That is, a composition in which the friction coefficient is small under a load from normal temperatures to high temperatures, the difference between static friction and dynamic friction is small, and the change in the friction coefficient is small even after repeated operation.

In view of this situation, it is an object of the present invention to provide a grease that strongly adheres between the ball stud and the ball seat under a load from normal temperatures to high temperatures, that flows smoothly while maintaining a constant film thickness in sliding portions going from a stationary state to a moving state, and that provides stable lubricating characteristics with very little change in the lubricating film even after repeated operation. In other words, the present invention provides a grease composition for ball joints in which the friction coefficient is small under a load from normal temperatures to high temperatures, the difference between the static friction and dynamic friction is small, and the change in the friction coefficient is small even after repeated operation.

As a result of extensive research conducted to achieve this object, the present inventors discovered a formulation technique for a good overall balance of a small friction coefficient under a load from normal temperatures to high temperatures, a small difference between the static friction and dynamic friction, and a small change in the friction coefficient even after repeated operation between a metal ball stud and a resin ball seat by blending a polyisoprene rubber and/or a polyisoprene rubber viscous material, an aliphatic amide and/or an aliphatic bisamide, and a specific urea compound. The present invention is a product of this discovery.

SUMMARY OF THE INVENTION

The present invention provides a grease composition for a ball joint, comprising:

(A) (i) a polyisoprene rubber and/or (ii) a polyisoprene rubber viscous material;

(B) an aliphatic amide represented by General Formula (1)

$$R_1CONH_2 \quad (1)$$

wherein $R_1$ represents a saturated or unsaturated alkyl group having from 15 to 21 carbon atoms; and/or an aliphatic bisamide represented by General Formula (2)

$$R_2CONHR_3NHCOR_2 \quad (2)$$

wherein $R_2$ represents a saturated or unsaturated alkyl group having from 15 to 17 carbon atoms and $R_3$ represents a methylene group or an ethylene group; and (C) at least one compound selected from among the compounds represented by the general formulae (3), (4) and (5)

$$R_4NHCONHR_5NHCONHR_4 \quad (3)$$

$$R_6NHCONHR_5NHCONHR_6 \quad (4)$$

$$R_4NHCONHR_5NHCONHR_6 \quad (5)$$

wherein $R_5$ is a diphenylmethane group, $R_4$ is an alkyl group having 8 carbon atoms, and $R_6$ is an unsaturated hydrocarbon group having from 14 to 20 carbon atoms.

DETAILED DESCRIPTION OF THE INVENTION

Figure 1:
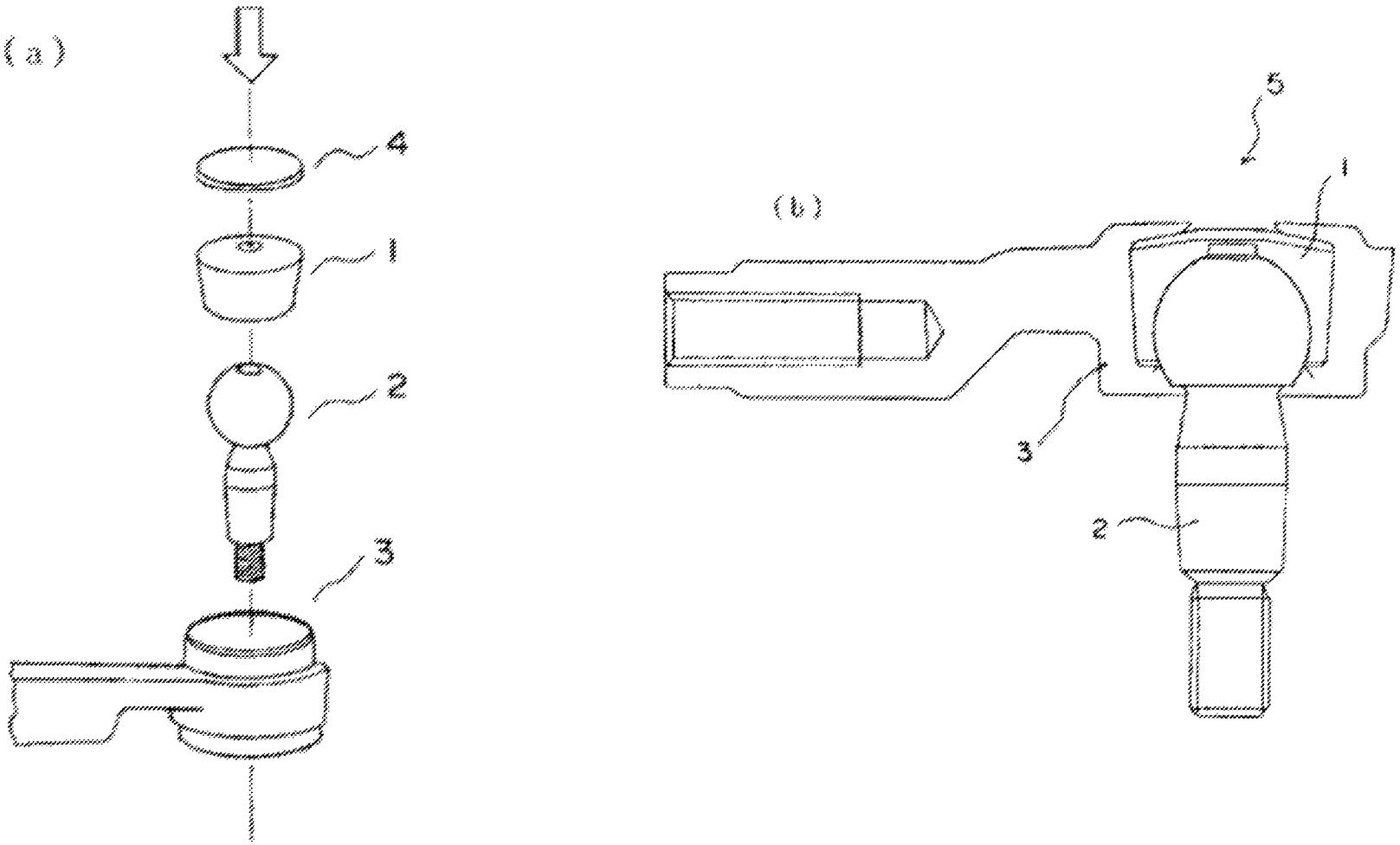
FIG. 1 is a schematic diagram of the structure of a plastic ball joint in which (a) shows the components and their assembly and (b) shows the assembled product.

The present invention is able to provide a high-performance grease composition for a ball joint consisting of a synthetic resin ball seat, metal ball stud, and a socket in which the grease composition for a ball joint has a good overall balance of a low friction coefficient from normal temperatures to high temperatures, a small difference between static friction and dynamic friction, and little change in the friction coefficient even after repeated operation.

The present invention relates to a grease composition for a ball joint. Said grease composition may be obtained by blending a thickener, an amide compound, a urea component and, optionally, a base oil and additives. The following is a detailed description of the specific components, blended amounts of each component, manufacturing method, physical properties, and applications of a grease composition for a ball joint according to the present invention. However, the present invention is not limited to the following description.

While not particularly limited, the polyisoprene rubber used in a grease composition of the present embodiment may be any one having the following chemical formulas:

$$—CH_2—(CH_3)C{=}CH—CH_2— \quad (6)$$

$$—CH_2—CH—CH_2—(CH_3)CH_2— \quad (7)$$

$$—CH_2—CH{=}CH—CH_2— \quad (8)$$

$$—CH_2—(R_7)CH— \quad (9)$$

wherein $R_7$ represents an aromatic hydrocarbon group or may be a block copolymer of (6) and (7) or (6) and (8) or (6) and (9).

Here, the weight average molecular weight of the polyisoprene rubber, that is, the weight average molecular weight of the polyisoprene rubber serving as a thickener is preferably 20,000 to 50,000, more preferably 25,000 to 45,000, and still more preferably 30,000 to 40,000. Here, the weight average molecular weight is calculated in terms of standard polystyrene by gel permeation chromatography analysis. Also, the polyisoprene rubber viscous material is a viscous material obtained by adding a mineral oil and/or a synthetic oil to these polyisoprene rubbers. The mixing ratio is not particularly limited but is preferably from $3\times10^3$ to $3\times10^5$ centipoises, more preferably from $5\times10^3$ to $8\times10^4$ centipoises, and still more preferably from $10^4$ to $6\times10^4$ centipoises. The viscosity (25° C.) of the resulting mixed viscous material is preferably in a range from $3\times10^3$ to $3\times10^5$ centipoises. Here, the viscosity is measured using a coaxial double cylinder rotary viscometer (B-type viscometer) as classified according to JIS Z 8803 (2011).

A polyisoprene rubber viscous material can be obtained by mixing the polyisoprene rubber used in the grease composition of the present embodiment with a mineral oil and/or synthetic oil, but there are no particular restrictions on the base oil. For example, any mineral oil, synthetic oil, animal or vegetable oil, or mixed oil used in ordinary grease compositions can be used. Specific examples include Groups 1 to 5 in the base oil categories of the American Petroleum Institute (API). The API base oil categories are a broad classification of base oil materials defined by the American Petroleum Institute in order to create guidelines for lubricant base oils.

There are no particular restrictions on the types of mineral oils used in the present embodiment. Preferred examples of mineral oils include paraffinic or naphthenic mineral oils obtained by any combination of one or more refining means such as solvent degassing, solvent extraction, hydrogenolysis, solvent dewaxing, catalytic dewaxing, hydrorefining, sulfuric acid washing, and clay treatment applied to lubricating oil fractions obtained by atmospheric distillation and vacuum distillation of crude oil.

There are no particular restrictions on the types of synthetic oils used in the present embodiment, but preferred examples include poly α-olefin (PAO) and hydrocarbon-based synthetic oils (oligomers). A PAO is a homopolymer or copolymer of an α-olefin. An α-olefin is a compound with a C=C double bond at the end, and specific examples include butene, butadiene, hexene, cyclohexene, methylcyclohexene, octene, nonene, decene, dodecene, tetradecene, hexadecene, octadecene, and eicosene. Specific examples of hydrocarbon-based synthetic oils (oligomers) include homopolymers or copolymers of ethylene, propylene or isobutene. These compounds can be used alone or in mixtures of two or more. These compounds may have any isomeric structure and may have a branched structure or a linear structure as long as they have a terminal C=C double bond. Also, two or more of these structural isomers and regioisomers with double bonds can be used in combination. Among these olefins, use of a linear olefin having from 6 to 30 carbon atoms is especially preferred because the flash point is low when the number of carbon atoms is 5 or less and the viscosity is high and usefulness low when the number of carbon atoms is 31 or more.

In the present embodiment, the base oil may be a gas to liquids (GTL) base oil synthesized using the Fischer-Tropsch method, which is a technique used to convert natural gas into liquid fuel. GTL base oils have a very low sulfur content and aromatic content and a very high paraffin content compared to mineral base oils refined from crude oil, and so have excellent oxidation stability and very low evaporation loss. As a result, they can be used as a base oil.

The amide compound used in the present embodiment can be an aliphatic amide represented by General Formula (1)

$$R_1CONH_2 \quad (1)$$

wherein $R_1$ represents a saturated or unsaturated alkyl group having from 15 to 21 carbon atoms, and/or an aliphatic bisamide represented by General Formula (2)

$$R_2CONHR_3NHCOR_2 \quad (2)$$

wherein $R_2$ represents a saturated or unsaturated alkyl group having from 15 to 17 carbon atoms and $R_3$ represents a methylene group or ethylene group.

Specific examples of aliphatic amides and aliphatic bisamides include palmitic acid amides, palmitoleic acid amides, margaric acid amides, stearic acid amides, oleic acid amides, baccenic acid amides, linoleic acid amides, linolenic acid amides, eleostearic acid amides, arachidic acid amides, eicosadienoic acid amides, mead acid amides, arachidonic acid amides, erucic acid amides, behenic acid amides, methylene bispalmitic acid amides, methylene bispalmitoleic acid amides, methylene bismargaric acid amides, methylene bisstearic acid amides, methylene bisoleic acid amides, methylene bissuccenic acid amides, methylene bislinoleic acid amides, methylene bislinolenic acid amides, methylene biseleostearic acid amides, ethylene bispalmitic acid amides, ethylene bispalmitoleic acid amides, ethylene bismargaric acid amides, ethylene bisstearic acid amides, ethylene bisoleic acid amides, ethylene bisbaccenoic acid amides, ethylene bislinoleic acid amides, ethylene bislinolenic acid amides, and ethylene biseleostearic acid amides.

The urea compound used in the present embodiment is at least one type of compound selected from the compounds represented by the following general formulae (3) to (5).

$$R_4NHCONHR_5NHCONHR_4 \quad (3)$$

$$R_6NHCONHR_5NHCONHR_6 \quad (4)$$

$$R_4NHCONHR_5NHCONHR_6 \quad (5)$$

In these formulae, $R_5$ represents a diphenylmethane group, $R_4$ represents an alkyl group having 8 carbon atoms, and $R_6$ represents an unsaturated hydrocarbon group having from 14 to 20 carbon atoms.)

Here, the molar ratio of $R_6$ to $R_4$ ($R_6/R_4$) is preferably from 0.10 to 3.00 and more preferably from 0.15 to 2.50.

The urea compound can be manufactured by reacting 1 mol of diisocyanate with 2 mol of primary monoamine (Manufacturing Method 1) or by reacting 2 mol of monoisocyanate with 2 mol of primary diamine (Manufacturing Method 2).

Typical examples of diisocyanates that can be used as the raw material in Manufacturing Method 1 include 4,4'-diphenylmethane diisocyanate (MDI). As for primary monoamines, R4 sources include octylamine and R6 sources include oleylamine, 9,12-octadecadien-1-amine, tallow amine, and hydrogenated tallow amine. Also, typical examples of monoisocyanates that can be used as the raw material for the $R_4$ source of the urea compound (C) in Manufacturing Method 2 include octyl isocyanate. Examples of diamines that can be used as the raw material for the $R_5$ source include 4,4'-diaminodiphenylmethane.

In a grease composition for a ball joint according to the present embodiment, optional components such as other thickeners and additives can be added in an amount of about 0.1 to 20 parts by mass (all optional components) per 100 parts by mass of the entire grease composition.

Thickeners other than the urea compounds described in the examples below include diurea thickeners, tetraurea thickeners, triurea monourethanes, other urea-based thickeners such as polyureas, and mixtures thereof. Inorganic thickeners include tertiary calcium phosphate and alkali metal soaps, alkali metal complex soaps, alkaline earth metal soaps, alkaline earth metal complex soaps, alkali metal sulfonates, alkaline earth metal sulfonates and other metal soaps, terephthalamate metal salts, clays, silicas (silicon oxides) such as silica air gel, and fluororesins such as polytetrafluoroethylene. These can be used alone or in combinations of two or more. Any other thickener that can impart a viscous effect to a liquid substance can also be used.

Additives include antioxidants, rust inhibitors, oiliness agents, extreme pressure agents, antiwear agents, solid lubricants, metal deactivators, polymers, nonmetal detergents, colorants, and water repellents. Examples of antioxidants include 2,6-di-t-butyl-4-methylphenol, 2,6-di-t-butylparacresol, p,p'-dioctyldiphenylamine, N-phenyl-α-naphthylamine, and phenothiazine. Examples of rust inhibitors include oxidized paraffin, carboxylic acid metal salts, sulfonic acid metal salts, carboxylic acid esters, sulfonic acid esters, salicylic acid esters, succinic acid esters, sorbitan esters, and various amine salts. Examples of oiliness agents, extreme pressure agents and antiwear agents include sulfurized dialkyl dithiophosphates, sulfurized zinc diallyl dithiophosphates, sulfurized zinc dialkyl dithiocarbamates, sulfurized zinc diallyl dithiocarbamates, sulfurized zinc dialkyl dithiophosphate molybutenes, sulfurized zinc diallyl dithiophosphate molybutenes, sulfurized zinc dialkyl dithiocarbamate molybutenes, sulfurized zinc diallyl dithiocarbamate molybutenes, organic molybdenum complexes, sulfurized olefins, triphenyl phosphate, triphenyl phosphorothioate, trikresin phosphate, phosphate esters, and sulfurized fats and oils. Examples of solid lubricants include molybdenum disulfide, graphite, boron nitride, melamine cyanurate, polytetrafluoroethylene (PTFE), tungsten disulfide, and graphite fluoride. Examples of metal deactivators include N,N'-disalicylidene-1,2-diaminopropane, benzotriazole, benzimidazole, benzothiazole, and thiadiazole. Examples of polymers include polybutene, polyisobutene, polyisobutylene, and polymethacrylate. Nonmetallic detergents include succinimides.

The following is an explanation of the blended amounts of the thickener, amide compound and urea compound in a grease composition according to the present embodiment. The components may be blended in the following The blended amount of polyisoprene rubber and/or polyisoprene rubber viscous material per 100 parts by mass of the entire grease composition is preferably from 30 to 70 parts by mass, more preferably from 35 to 65 parts by mass, and still more preferably from 40 to 60 parts by mass.

The blending amount of amide compound (aliphatic amide and/or aliphatic bisamide compound) per 100 parts by mass of the entire grease composition is preferably from 10 to 50 parts by mass, more preferably from 15 to 45 parts by mass, and still more preferably from 20 to 40 parts by mass.

The blending amount of urea compound per 100 parts by mass of the entire grease composition is preferably from 1 to 15 parts by mass, more preferably from 1.5 to 10 parts by mass, and still more preferably from 2 to 8 parts by mass.

DESCRIPTION OF THE DRAWINGS

Figure 2:
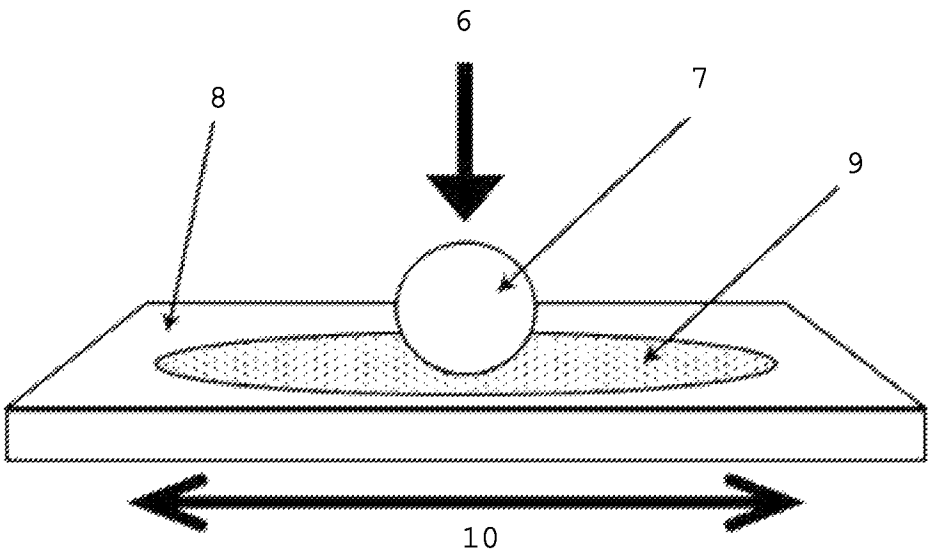
FIG. 2 is a conceptual diagram of the Bowden friction test in the Examples.
Figure 3:
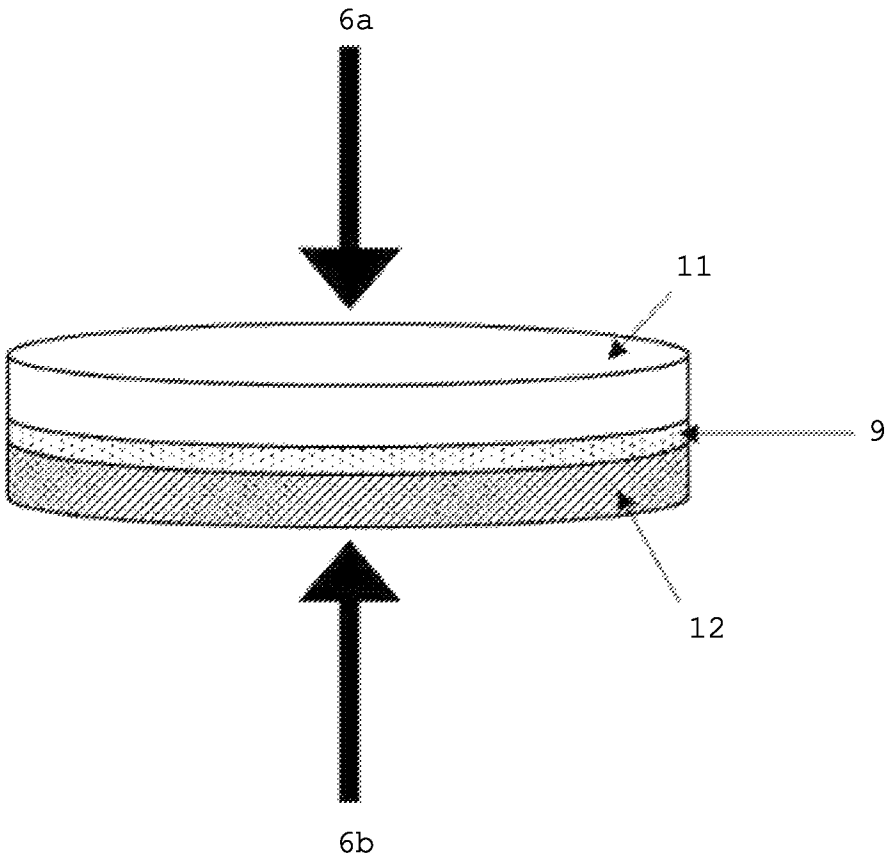
FIG. 3 is a conceptual diagram of the grease film measurement test in the Examples.

The following reference numerals are included in FIGS. 1 to 3 and refer to the following elements.

1 Ball Seat
2 Ball Stud
3 Socket
4 Steel Plate
5 Ball Joint
6, 6*a*, 6*b* Load
7 Test piece a
8 Test piece b
9 Test Grease
10 Reciprocating motion
11 Test piece c
12 Test piece d

EXAMPLES

The following is a more detailed description of the present invention with reference to Examples and Comparative Examples. However, the present invention is in no way limited by these Examples. The raw materials used in the Examples and Comparative Examples are abbreviated as follows.

1. The following were used as the thickeners (A).
   - Polyisoprene A: This is a polyisoprene homopolymer having a weight average molecular weight of 28,000.
   - Polyisoprene B: This is a hydrogenated polyisoprene copolymer having a weight average molecular weight of 31,000.

Diluting Oils
   - Base Oil A: This is a mineral oil having a dynamic viscosity at 40° C. of 101.1 $mm^2/s$.
   - Base Oil B: This is a poly α-olefin oil having a dynamic viscosity at 40° C. of 18.5 $mm^2/s$.
   - Base Oil C: This is a GTL having a dynamic viscosity at 40° C. of 47.08 $mm^2/s$, a dynamic viscosity at 100° C. of 8.04 $mm^2/s$, a viscosity index of 146, % CA of 1 or less, % CN of 11.9 and % CP of 85 or more.

2. The following were used as the amide compounds (B).
   - Amide A: This is oleylamide.
   - Amide B: This is ethylene bisstearylamide.

3. The following were used as the raw materials for the urea compound (C).

The isocyanate raw material is:
   - Diphenylmethane-4,4'-diisocyanate (MDI) (molecular weight 250.26).

The amine raw materials are the following.
   - Amine A: This is industrial octylamine having an average molecular weight of 128.7 and primarily composed of a saturated hydrocarbon group having 8 carbon atoms (90% by mass or more).
   - Amine B: This is industrial stearylamine having an average molecular weight of 258.7 and primarily composed of a saturated hydrocarbon group having 18 carbon atoms (90% by mass or more).
   - Amine C: This is industrial oleylamine having an average molecular weight of 255.0 and primarily composed of an unsaturated hydrocarbon group having 18 carbon atoms (70% by mass or more).
   - Amine D: This is industrial dodecylamine having an average molecular weight of 184.6 and primarily composed of an unsaturated hydrocarbon group having 12 carbon atoms (90% by mass or more).

Examples 1 to 5

The MDI and the polyisoprene rubber at the blending ratios shown in Table 1A were placed in a grease pot and heated to about 100° C. to dissolve the MDI. The required amount of amine A (octylamine) was then gradually added and the contents were stirred vigorously. After about 10 minutes, amine C (oleylamine) was also gradually added and stirring was continued. The contents were heated to 170° C. and the temperature was maintained for about 30 minutes to complete the reaction. After cooling, amide A and amide B were added and melted at about 160° C. and then thoroughly kneaded. Further, this was cooled to room temperature and processed with a triple roll to obtain a lubricating oil composition.

Example 6

The MDI and the polyisoprene rubber at the blending ratios shown in Table 1A were placed in a grease pot and heated to about 100° C. to dissolve the MDI. The required amount of amine A (octylamine) and amine C (oleylamine) were then gradually added and the contents were stirred vigorously for about ten minutes. The contents were then heated to 170° C. and the temperature was maintained for about 30 minutes to complete the reaction. After cooling, amide A and amide B were added and melted at about 160° C. and then thoroughly kneaded. Further, this was cooled to room temperature and processed with a triple roll to obtain a lubricating oil composition.

Example 7

The lubricating oil composition in Example 1 and the lubricating oil composition in Example 6 were added in equal amounts to a grease pot, kneaded at about 60° C., and processed with a triple roll to obtain a lubricating oil composition.

Example 8

The MDI and the polyisoprene rubber at the blending ratios shown in Table 1A were placed in a grease pot and heated to about 100° C. to dissolve the MDI. The required amount of amine A (octylamine) was then gradually added and the contents were stirred vigorously. After about 10 minutes, amine B (stearylamine) and amine C (oleylamine) were also gradually added and stirring was continued. The contents were heated to 170° C. and the temperature was maintained for about 30 minutes to complete the reaction. After cooling, amide A and amide B were added and melted at about 160° C. and then thoroughly kneaded. Further, this was cooled to room temperature and processed with a triple roll to obtain a lubricating oil composition.

Examples 9 to 10

The MDI and the polyisoprene rubber at the blending ratios shown in Table 1A and Table 1B were placed in a grease pot and heated to about 100° C. to dissolve the MDI. The required amount of amine A (octylamine) was then gradually added and the contents were stirred vigorously. After about 10 minutes, amine C (oleylamine) was also gradually added and stirring was continued. The contents were heated to 170° C. and the temperature was maintained for about 30 minutes to complete the reaction. After cooling, the amide was added and melted at about 160° C. and then thoroughly kneaded. Further, this was cooled to room temperature and processed with a triple roll to obtain a lubricating oil composition.

Examples 11 to 15

The MDI and the polyisoprene rubber at the blending ratios shown in Table 1B were placed in a grease pot and heated to about 100° C. to dissolve the MDI. The required amount of amine A (octylamine) was then gradually added and the contents were stirred vigorously. After about 10 minutes, amine C (oleylamine) was also gradually added and stirring was continued. The contents were then heated to 170° C. and the temperature was maintained for about 30 minutes to complete the reaction. After cooling, the amide was added and melted at about 160° C. and then thoroughly kneaded. Further, this was cooled to room temperature and processed with a triple roll to obtain a lubricating oil composition.

Comparative Examples 1 to 2

The MDI and the polyisoprene rubber at the blending ratios shown in Table 1B were placed in a grease pot and heated to about 100° C. to dissolve the MDI. The amine was then gradually added and the contents were stirred vigorously for about 10 minutes. The contents were heated to 170° C. and the temperature was maintained for about 30 minutes to complete the reaction. After cooling, the amide was added and melted at about 160° C. and then thoroughly kneaded. Further, this was cooled to room temperature and processed with a triple roll to obtain a lubricating oil composition.

Comparative Example 3

The polyisoprene rubber and the base oil at the blending ratios shown in Table 1B were placed in a grease pot and heated. Amine A and amine B were added at about 100° C., and the contents were heated to about 160° C. and stirred vigorously. Further, this was cooled to room temperature and processed with a triple roll to obtain a lubricating oil composition.

The following measurements and tests were performed to compare the properties and performance of the examples and comparative examples.

Consistency was measured according to JIS K 2220-7.

Dropping Point was measured according to JIS K2220-8.

Viscosity was measured by a coaxial double cylinder rotary viscometer (B-type viscometer) as classified according to JIS Z 8803 (2011).

Bowden Friction Test (as shown in Figure. 2): the coefficient of friction between test piece a and test piece b opposing each other was measured using a Bowden friction tester under the following test conditions. Specifically, a load was applied to test piece a in the longitudinal direction, test piece b was moved back and forth in the lateral direction, and the force applied to test piece a was measured as the frictional force. The frictional force was determined over 10 reciprocations by measuring the coefficient of static friction at the start of movement and the coefficient of dynamic friction during the sliding movement for each reciprocation. The reported static friction coefficient and dynamic friction coefficient are the average values over 10 reciprocations.

(1) Test Piece a: Material: SUJ2
Dimensions: Steel ball with 5.0 mm outer diameter
(2) Test Piece b: Material: Polyacetal resin
Dimensions: 120 mm long, 35 mm wide, 4 mm thick plate
(3) Temperatures: 25° C., 80° C.
(4) Sliding Speed: 1.0 mm/s
(5) Load: 19.61 N
(6) Contact Surface Pressure: 120 MPa
(7) Sliding Action: 10 Reciprocations Grease Film Measurement Test (as shown in FIG. 3): grease is applied between the two surfaces of test piece c and test piece d, and the film thickness is calculated from the amount of grease remaining after compression for 60 minutes under a load of 20 kN. Specifically, the weights of test piece c and test piece d were weighed in advance, grease was uniformly applied to the surface of the disks, and the coated surfaces were placed together. The greased disks were placed in a compactor and left for 60 minutes under 25° C. and 80° C. Afterwards, both discs were removed from the compactor, the excess grease was wiped off, and both disks were weighed. The difference in the before and after weights of the two disks was the remaining amount of grease, and the grease film thickness was calculated and evaluated based on this weight.

(1) Test Piece c: Material: S45C steel
Dimensions: Disk with an outer diameter of 60 mm and a thickness of 4 mm
(2) Test Piece d: Material: Polyacetal resin
Dimensions: Disk with an outer diameter of 60 mm and a thickness of 4 mm
(3) Temperatures: 25° C., 80° C.
(4) Load: 20 kN
(5) Holding Time: 60 minutes
(6) Equation for Calculating Grease Film Thickness:

$$\text{Grease Film Thickness} = \frac{\text{Weight of Applied Grease} \times (1/\text{specific gravity})}{\text{Area of disc}}$$

The test results are shown in Table 1A and Table 1B. The ball joint grease compositions in Examples 1 to 15 have high dropping points, which is an index of heat resistance, and have low static friction coefficients and dynamic friction coefficients at 25° C. and 80° C. in the Bowden test. The rate of change in static/dynamic friction is also small. In other words, they exhibit excellent friction characteristics. In the test results from measuring the grease film, in all of the ball joint grease compositions in Examples 1 to 15, a sufficient grease film thickness was maintained under load and the grease film was maintained on the sliding surface when allowed to stand for a long period of time, suggesting that smooth torque can be stably provided. Because these characteristics change very little even when the temperature rises, sufficient lubricity can be ensured in high temperature environments. In contrast, the grease composition in Comparative Example 1 has a high dropping point, but both the static friction coefficient and the dynamic friction coefficient are high in the Bowden test regardless of temperature, and the rate of change in static/dynamic friction is also high. In the test results from measuring the grease film, the grease film becomes thin when the temperature reaches 80° C., so sufficient lubrication cannot be expected when allowed to stand for a long period of time. The grease compositions in Comparative Examples 2 and 3 have low dropping points, high coefficients of static friction and dynamic friction in the Bowden test regardless of temperature, and a high rate of change in static/dynamic friction. In the test results from measuring the grease film, the grease film becomes thin when the temperature reaches 80° C., so sufficient lubrication cannot be expected when allowed to stand for a long period of time. It is clear from these results that the grease compositions for ball joints in the present invention can exhibit sufficient performance.

TABLE 1A

| | | | Example/Comparative Example | | | | | | | | |
|---|---|---|---|---|---|---|---|---|---|---|---|
| | | | Ex. 1 | Ex. 2 | Ex. 3 | Ex. 4 | Ex. 5 | Ex. 6 | Ex. 7 | Ex. 8 | Ex. 9 |
| (A) Thickener (mass %) | | | | | | | | | | | |
| Polyisoprene A | | | 64 | 64 | 64 | 64 | 64 | 64 | 64 | 64 | 64 |
| Polyisoprene B | | | — | — | | | | | | | |
| Diluting Oil (mass %) | | | — | — | — | — | — | — | — | — | — |
| Lubricating Oil A | | | | | | | | | | | |
| Lubricating Oil B | | | — | — | — | — | — | — | — | — | — |
| Lubricating Oil C | | | — | — | — | — | — | — | — | — | — |
| Thickener Total (mass %) | | | 64 | 65 | 64 | 64 | 64 | 64 | 64 | 64 | 64 |
| Thickener Viscosity 25° C. mPa · s | | | $1.7 \times 10^5$ | $1.7 \times 10^5$ | $1.7 \times 10^5$ | $1.7 \times 10^5$ | $1.7 \times 10^5$ | $1.7 \times 10^5$ | $1.7 \times 10^5$ | $1.7 \times 10^5$ | $1.7 \times 10^5$ |
| (B) Amide Compound (mass %) | | | 15 | 16.5 | 12.0 | 15 | 15 | 15 | 15 | 15 | 30 |
| Amide A | | | | | | | | | | | |
| Amide B | | | 15 | 16.5 | 12.0 | 15 | 15 | 15 | 15 | 15 | — |
| Amide Compound Total (mass %) | | | 30 | 33 | 24 | 30 | 30 | 30 | 30 | 30 | 30 |
| (C) Urea Compound Raw Material (mass %) | | | 2.47 | 1.03 | 4.94 | 2.71 | 2.23 | 2.38 | 2.43 | 2.46 | 2.47 |
| Raw Material | | | | | | | | | | | |
| MDI | | | | | | | | | | | |
| Amine A C8 | | | 1.52 | 0.63 | 3.04 | 2.29 | 0.77 | 1.23 | 1.38 | 1.52 | 1.52 |
| Amine B C18 | | | — | — | — | — | — | — | — | 1.32 | — |
| Amine C C14'-C18' | | | 2.01 | 0.84 | 4.02 | 1.00 | 3.01 | 2.40 | 2.20 | 0.71 | 2.01 |
| Amine D C12 | | | — | — | — | — | — | — | — | — | — |
| Urea Compound Total (mass %) | | | 6.0 | 2.5 | 12.0 | 6.0 | 6.0 | 6.0 | 6.0 | 6.0 | 6.0 |
| Ratio of Urea Compound R6 to R4 (R6/R4, mol %) | | | 0.67 | 0.67 | 0.67 | 0.22 | 1.99 | 0.98 | 0.81 | 0.66 | 0.67 |
| Total | | | 100 | 100 | 100 | 100 | 100 | 100 | 100 | 100 | 100 |
| Consistency | | | 260 | 270 | 218 | 266 | 265 | 263 | 269 | 264 | 269 |
| Dropping Point ° C. | | | 241 | 200 | 268 | 243 | 246 | 242 | 243 | 240 | 219 |
| Bowden Friction Test | 25° C. | Static Friction Coeff. | 0.036 | 0.033 | 0.032 | 0.032 | 0.035 | 0.036 | 0.033 | 0.034 | 0.033 |
| Bearing Steel-POM Material Surface Pressure 120 MPa Sliding Speed 1 mm/s | | Dynamic Friction Coeff. | 0.032 | 0.032 | 0.030 | 0.032 | 0.034 | 0.036 | 0.031 | 0.032 | 0.033 |
| | | Static/Dynamic Rate Change % | −0.111 | −0.030 | −0.063 | 0.000 | −0.029 | 0.000 | −0.061 | −0.059 | 0.000 |
| | 80° C. | Static Friction Coeff. | 0.033 | 0.030 | 0.030 | 0.029 | 0.031 | 0.033 | 0.031 | 0.031 | 0.032 |
| | | Dynamic Friction Coeff. | 0.030 | 0.029 | 0.028 | 0.029 | 0.029 | 0.030 | 0.029 | 0.030 | 0.030 |
| | | Static/Dynamic Rate Change % | −0.091 | −0.033 | −0.067 | 0.000 | −0.065 | −0.091 | −0.065 | −0.032 | −0.063 |
| Grease Film Measurement Test | 25° C. | Film Thickness μm | 12.45 | 11.21 | 13.32 | 12.11 | 12.05 | 12.13 | 12.23 | 12.07 | 12.15 |
| | 80° C. | Film Thickness μm | 7.13 | 5.51 | 7.99 | 7.12 | 7.03 | 7.11 | 7.06 | 7.05 | 7.13 |

TABLE 1B

| | Example/Comparative Example | | | | | | | | |
|---|---|---|---|---|---|---|---|---|---|
| | Ex. 10 | Ex. 11 | Ex. 12 | Ex. 13 | Ex. 14 | Ex. 15 | C. Ex. 1 | C. Ex. 2 | C. Ex. 3 |
| (A) Thickener (mass %) | | | | | | | | | |
| Polyisoprene A | 64 | | | | | | | | |
| Polyisoprene B | | 28 | 28 | 28 | 28.0 | 28 | 28 | 28 | 33 |
| Diluting Oil (mass %) | — | | | | | 36.0 | | | |
| Lubricating Oil A | | | | | | | | | |
| Lubricating Oil B | — | | | | 36.0 | | — | — | — |
| Lubricating Oil C | — | 36.0 | 36.0 | 36.0 | | | 36.0 | 36.0 | 37.0 |
| Thickener Total (mass %) | 64 | 64.0 | 64.0 | 64.0 | 64.0 | 64.0 | 64.0 | 64.0 | 70.0 |

TABLE 1B-continued

| | | | Example/Comparative Example | | | | | | | | |
|---|---|---|---|---|---|---|---|---|---|---|---|
| | | | Ex. 10 | Ex. 11 | Ex. 12 | Ex. 13 | Ex. 14 | Ex. 15 | C. Ex. 1 | C. Ex. 2 | C. Ex. 3 |
| Thickener Viscosity 25° C. mPa · s | | | $1.7 \times 10^3$ | $1.8 \times 10^4$ | $1.8 \times 10^4$ | $1.8 \times 10^4$ | $1.45 \times 10^4$ | $2.8 \times 10^4$ | 1.8 × 104 | 1.8 × 104 | $2.5 \times 10^4$ |
| (B) Amide Compound (mass %) | | | — | 30 | — | 10 | 10 | 10 | 15 | 15 | 15 |
| Amide A | | | | | | | | | | | |
| Amide B | | | 30 | — | 30 | 20 | 20 | 20 | 15 | 15 | 15 |
| Amide Compound Total (mass %) | | | 30 | 30 | 30 | 30 | 30 | 30 | 30 | 30 | 30 |
| (C) Urea Compound Raw Material (mass %) | | | 2.47 | 2.47 | 2.47 | 2.47 | 2.47 | 2.47 | 2.42 | 1.90 | — |
| Raw Material | | | | | | | | | | | |
| MDI | | | | | | | | | | | |
| Amine A C8 | | | 1.52 | 1.52 | 1.52 | 1.52 | 1.52 | 1.52 | — | — | — |
| Amine B C18 | | | — | — | — | — | — | — | — | 4.10 | — |
| Amine C C14'-C18' | | | 2.01 | 2.01 | 2.01 | 2.01 | 2.01 | 2.01 | — | — | — |
| Amine D C12 | | | — | — | — | — | — | — | 3.58 | — | — |
| Urea Compound Total (mass %) | | | 6.0 | 6.0 | 6.0 | 6.0 | 6.0 | 6.0 | 6.0 | 6.0 | 0 |
| Ratio of Urea Compound R6 to R4 (R6/R4, mol %) | | | 0.67 | 0.67 | 0.67 | 0.67 | 0.67 | 0.67 | — | — | — |
| Total | | | 100 | 100 | 100 | 100 | 100 | 100 | 100 | 100 | 100 |
| Consistency | | | 268 | 270 | 266 | 267 | 264 | 259 | 282 | 271 | 292 |
| Dropping Point ° C. | | | 255 | 222 | 249 | 246 | 247 | 249 | 252 | 168 | 121 |
| Bowden Friction Test | 25° C. | Static Friction Coeff. | 0.034 | 0.033 | 0.034 | 0.032 | 0.033 | 0.031 | 0.046 | 0.042 | 0.041 |
| Bearing Steel-POM Material Surface Pressure 120 MPa Sliding Speed 1 mm/s | | Dynamic Friction Coeff. | 0.031 | 0.032 | 0.032 | 0.031 | 0.033 | 0.030 | 0.040 | 0.039 | 0.031 |
| | | Static/Dynamic Rate Change % | −0.088 | −0.030 | −0.059 | −0.031 | 0.000 | −0.032 | −0.130 | −0.071 | −0.244 |
| | 80° C. | Static Friction Coeff. | 0.032 | 0.029 | 0.031 | 0.030 | 0.031 | 0.030 | 0.049 | 0.048 | 0.037 |
| | | Dynamic Friction Coeff. | 0.029 | 0.028 | 0.030 | 0.028 | 0.029 | 0.030 | 0.042 | 0.042 | 0.031 |
| | | Static/Dynamic Rate Change % | −0.094 | −0.034 | −0.032 | −0.067 | −0.065 | 0.000 | −0.143 | −0.125 | −0.162 |
| Grease Film Measurement Test | 25° C. | Film Thickness μm | 12.79 | 10.68 | 10.92 | 10.33 | 10.23 | 10.36 | 9.75 | 10.35 | 12.19 |
| | 80° C. | Film Thickness μm | 7.21 | 6.78 | 6.58 | 6.88 | 6.94 | 6.91 | 4.79 | 4.96 | 4.24 |

That we claim:

1. A grease composition for a ball joint, said composition comprising:

(A) (i) a polyisoprene rubber and/or (ii) a polyisoprene rubber viscous material wherein the total amount of (A) is from 30 to 70 parts by mass per 100 parts by mass of the entire composition;

(B) an aliphatic amide represented by General Formula (1)

$$R_1CONH_2 \quad (1)$$

wherein $R_1$ represents a saturated or unsaturated alkyl group having from 15 to 21 carbon atoms; and/or an aliphatic bisamide represented by General Formula (2)

$$R_2CONHR_3NHCOR_2 \quad (2)$$

wherein $R_2$ represents a saturated or unsaturated alkyl group having from 15 to 17 carbon atoms and $R_3$ represents a methylene group or an ethylene group wherein the total amount of (B) is from 10 to 50 parts by mass per 100 parts by mass of the entire composition; and (C) at least one compound selected from among the compounds represented by the general formulae (3), (4) and (5)

$$R_4NHCONHR_5NHCONHR_4 \quad (3)$$

$$R_6NHCONHR_5NHCONHR_6 \quad (4)$$

$$R_4NHCONHR_5NHCONHR_6 \quad (5)$$

wherein $R_5$ is a diphenylmethane group, $R_4$ is an alkyl group having 8 carbon atoms, and $R_6$ is an unsaturated hydrocarbon group having from 14 to 20 carbon atoms, wherein the total amount of urea compound in (C) is from 1 to 15 parts by mass per 100 parts by mass of the entire composition and wherein the molar ratio ($R_6/R_4$) of $R_6$ to $R_4$ is from 0.10 to 3.00.

2. The grease composition for a ball joint according to claim 1, wherein component (i) in (A) is a polyisoprene rubber having a weight average molecular weight in a range from 20,000 to 50,000, and component (ii) is a polyisoprene rubber viscous material obtained by mixing a mineral oil and/or a synthetic oil and adjusting the viscosity at 25° C. to $3\times10^3$ to $3\times10^5$ centipoises.

* * * * *